US010702725B2

(12) United States Patent
Jessop

(10) Patent No.: US 10,702,725 B2
(45) Date of Patent: Jul. 7, 2020

(54) SAFETY TETHER ANCHOR AND SYSTEM FOR CONSTRUCTION WORKERS

(71) Applicant: Agra Tech, LLC, Cedar City, UT (US)

(72) Inventor: Shem Jessop, Cedar City, UT (US)

(73) Assignee: Agra Tech, LLC, Cedar City, UT (US)

( * ) Notice: Subject to any disclaimer, the term of this patent is extended or adjusted under 35 U.S.C. 154(b) by 0 days.

(21) Appl. No.: 16/188,508

(22) Filed: Nov. 13, 2018

(65) Prior Publication Data

US 2019/0143157 A1 May 16, 2019

Related U.S. Application Data

(60) Provisional application No. 62/585,407, filed on Nov. 13, 2017.

(51) Int. Cl.
*A47B 97/00* (2006.01)
*A62B 35/00* (2006.01)

(52) U.S. Cl.
CPC ..... *A62B 35/0068* (2013.01); *A62B 35/0056* (2013.01)

(58) Field of Classification Search
CPC ..... A62B 35/0068; A62B 35/0056; E04G 21/3223
See application file for complete search history.

(56) References Cited

U.S. PATENT DOCUMENTS 6,053,281 A * 4/2000 Murray ..... E04G 21/3223 182/113
6,173,809 B1 * 1/2001 Cole ..... E04G 21/3261 182/3
7,163,083 B2 * 1/2007 Argoud ..... A62B 35/04 182/113
8,025,125 B2 * 9/2011 Vetesnik ..... A62B 1/04 182/45
9,573,629 B2 * 2/2017 Conny ..... B62D 33/0207
10,323,422 B1 * 6/2019 Eddy ..... E04G 1/15

* cited by examiner

*Primary Examiner* — Amy J. Sterling
(74) *Attorney, Agent, or Firm* — Gurr Brande & Spendlove, PLLC; Robert A. Gurr

(57) ABSTRACT

A safety anchor for construction having a mounting plate for mounting to a vertical portion of a structure; a vertical support member coupled to the mounting plate and extending upwardly therefrom; and, a tethering component at a top end of the vertical support member. In one method of use, a first safety anchor is mounted to a first side of a structure, a second safety anchor is mounted to a second side of a structure, and a cable is interposed between the first and second safety anchors.

1 Claim, 6 Drawing Sheets

SAFETY TETHER ANCHOR AND SYSTEM FOR CONSTRUCTION WORKERS

CROSS-REFERENCE TO RELATED APPLICATIONS

This application claims the benefit of U.S. Provisional Application Ser. No. 62/585,407, filed on Nov. 13, 2017, which is incorporated herein by reference.

TECHNICAL FIELD

The present disclosure relates to construction safety equipment. More particularly, the present disclosure relates to the use of safety anchors for a horizontal safety tether system.

BACKGROUND

As a building is constructed, there is an obvious need to have workers working at elevated heights. Working off the ground is extremely perilous on a construction site, with several safety regulations in place to lessen the number and severity of incidences. However, often times, the safety equipment setup and maneuvering can have a negative impact on the timeline of completion for the construction project. For example, a worker on the roof should be tethered to the roof so as to prevent the worker from falling off the roof. However, most tethering systems limit the mobility of the worker, causing delays in the work.

In an attempt to overcome this problem, several inventions have been put forth by the prior art. For example, standalone tether posts, tethering hooks built into the structure, and other devices and methods have been proposed by the prior art. In addition, multi-point tether lines have been used, but are ineffective. For example, U.S. Pat. No. 9,248,323 to Larsen discusses similar problems in the art and cites prior technologies. However, while Larsen discloses a fall prevention apparatus that is easily attachable to a sloped roof, several pieces of equipment must be used, and ideally on a slope. Further, the tether line is then secured to the roof, making it difficult for a user to approach the tethering points when tethered at the hips.

Therefore, there remains a need for a safety tether that requires minimal assembly, that is easily removably attachable to a structure, and that allows for efficient mobility of the construction worker. The present invention seeks to solve these, and other, problems.

SUMMARY OF EXAMPLE EMBODIMENTS

In one embodiment, a safety anchor for construction comprises a mounting plate for mounting to a vertical portion of a structure; a vertical support member coupled to the mounting plate and extending upwardly therefrom; and, a tethering component at a top end of the vertical support member.

In one embodiment, a safety anchor for construction comprises a mounting plate comprising a first portion and a second portion, wherein the second portion is angled in relation to the first portion, the second portion having an aperture for receiving a support collar, and a female receiving member coupled to the support collar; at least one bracket for coupling the female receiving member to the mounting plate; a vertical support member telescopically coupled to the mounting plate via the female receiving member, the vertical support member extending upwardly from the mounting plate; and a tethering component at a top, distal end of the vertical support member.

In one embodiment, a safety tether system for construction workers comprises a first safety anchor and a second safety anchor and a cable interposed between the tethering ends of the first and second safety anchors.

DETAILED DESCRIPTION OF EXAMPLE EMBODIMENTS

Figure 1:
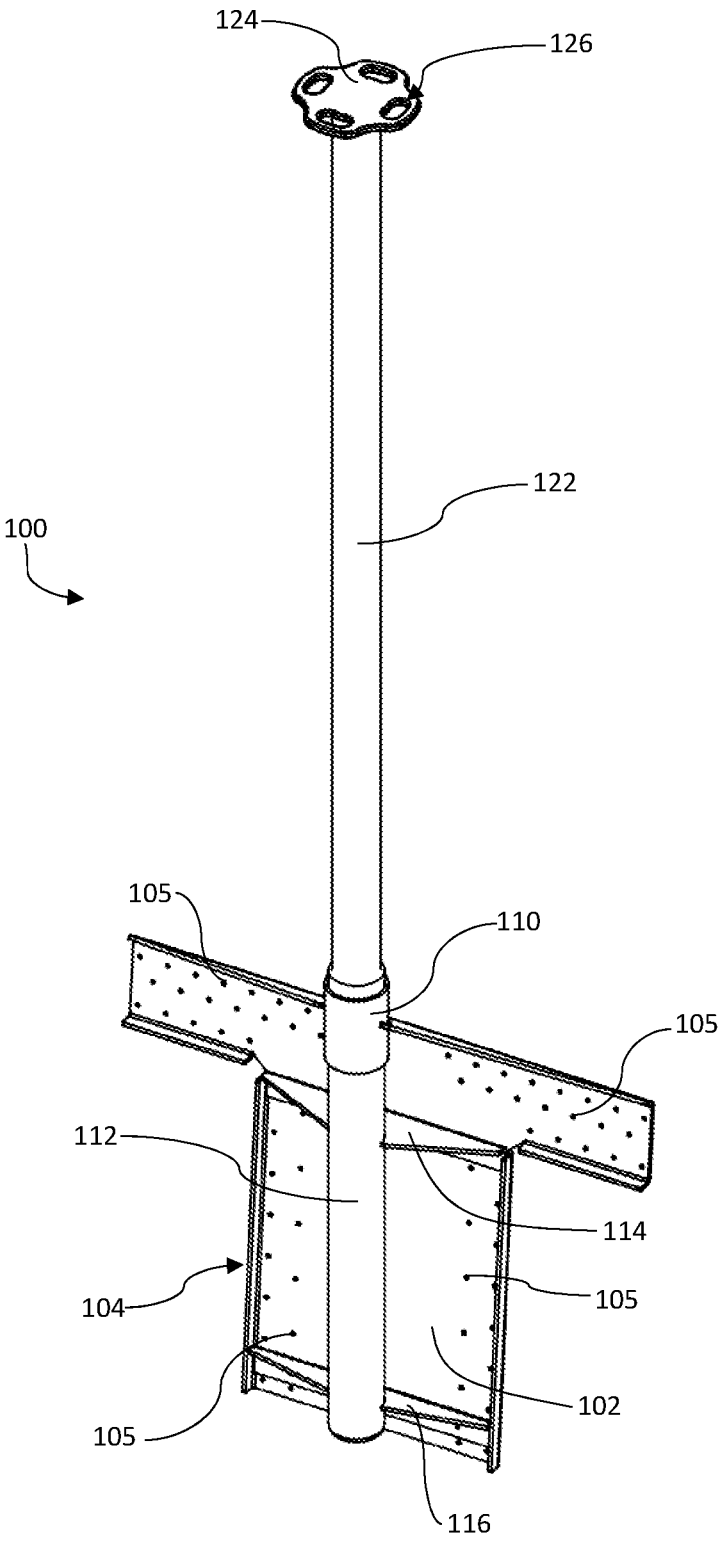
FIG. 1 is a perspective view of a safety anchor
Figure 2:
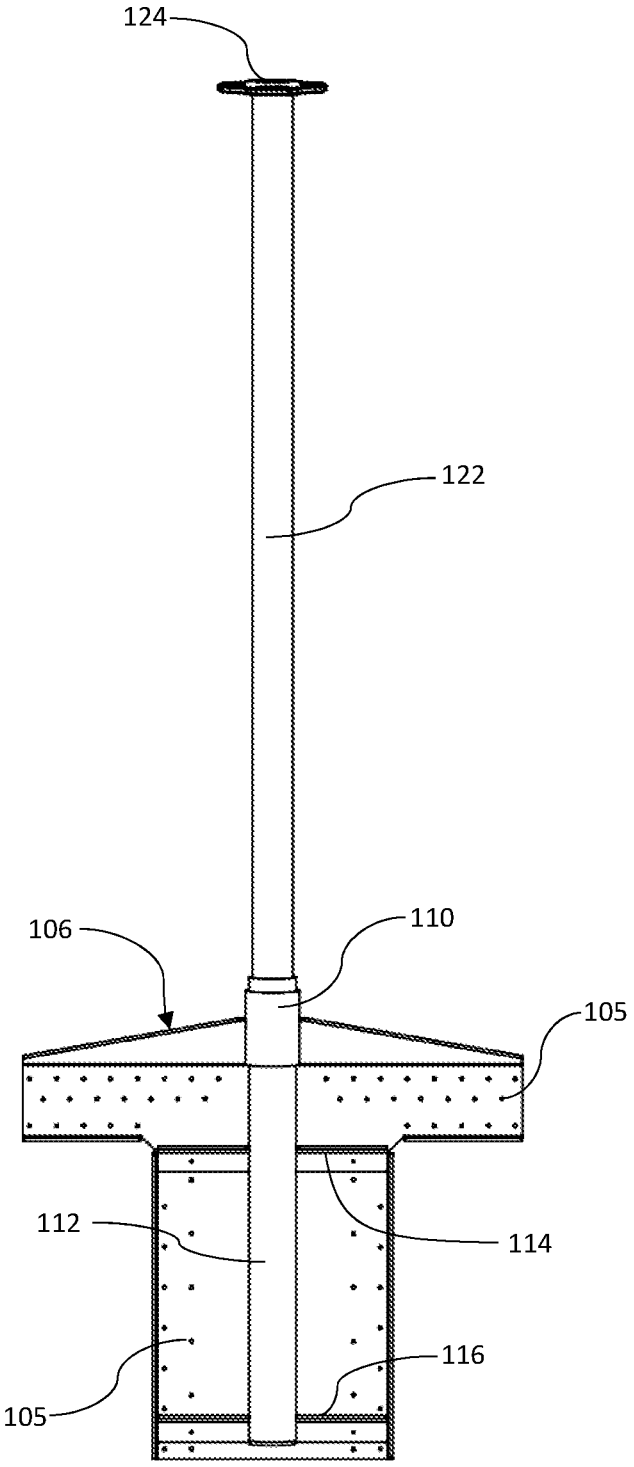
FIG. 2 is a front elevation view of a safety anchor.
Figure 3:
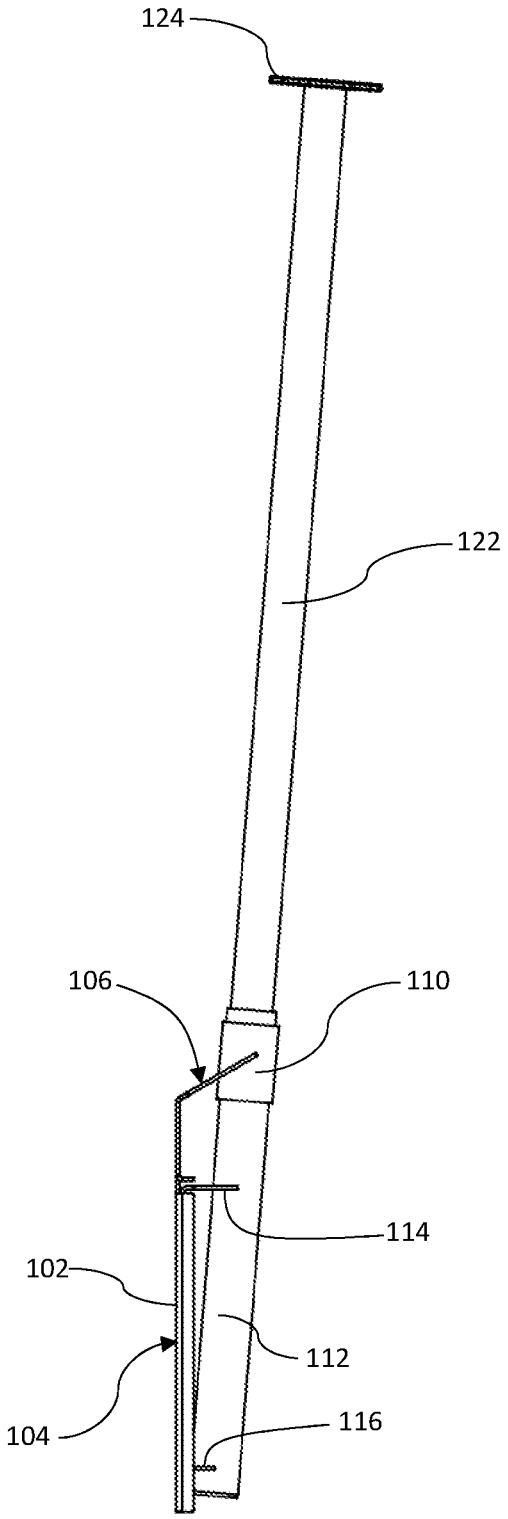
FIG. 3 is a side elevation view of safety anchor.
Figure 4:
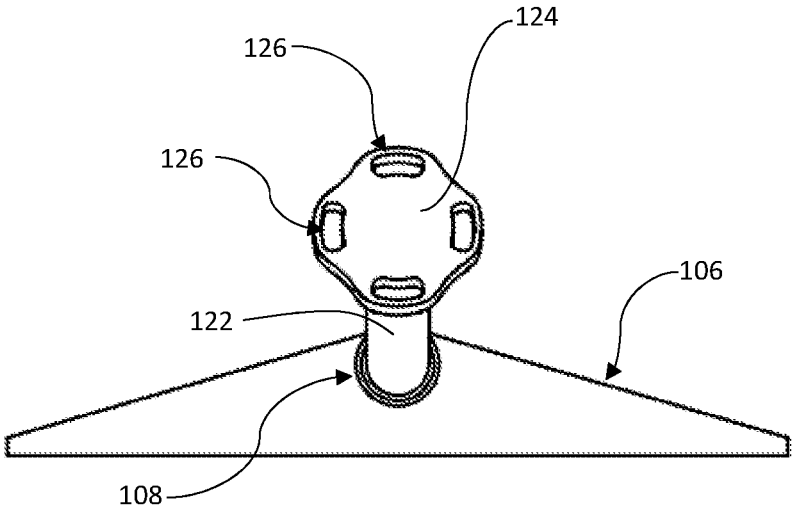
FIG. 4 is a top plan view of a safety anchor.
Figure 5:
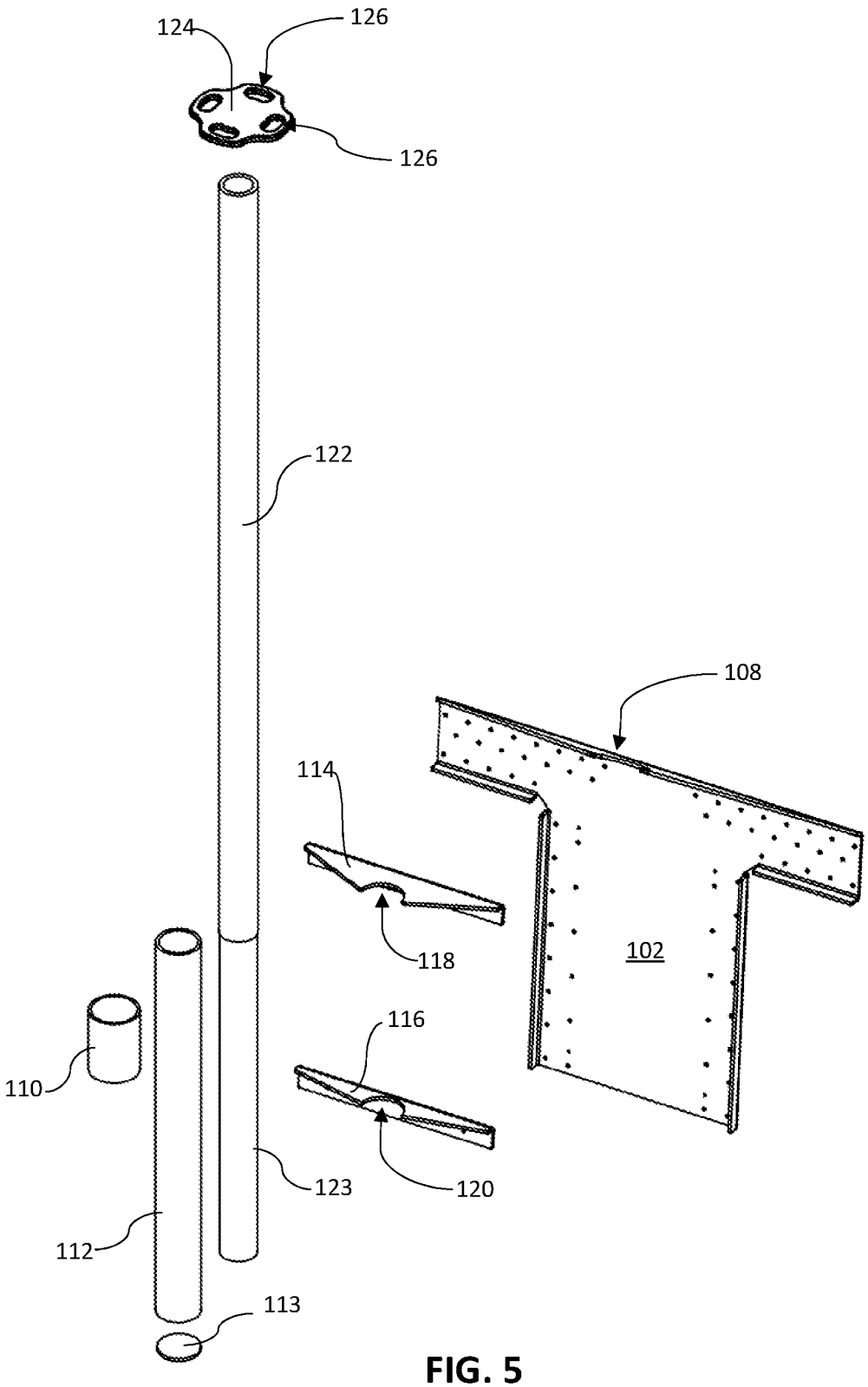
FIG. 5 is an exploded view of a safety anchor.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various different sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As will be appreciated from this disclosure, the safety anchor and safety tethering system solve the need for a safety tether system that requires minimal assembly, that is easily removably attachable to a structure, and that allows for efficient mobility of the construction worker.

In one embodiment, as shown in FIGS. 1-5, a safety anchor 100 comprises a mounting plate 102 comprising a first portion 104 and a second portion 106, wherein the second portion 106 is angled in relation to the first portion 104. The first portion 104 may further comprises a plurality of securing apertures 105 to allow the mounting plate 102 to be secured to a structure. For example, screws may be driven through securing apertures 105 and into the structure, thereby securing the mounting plate 102 to the structure. While screws were used as an example, other fastening means may also be used. The second portion 106 has an aperture 108 for receiving a support collar 110, the support collar 110 coupled to a female receiving member 112. To aid in securing the female receiving member 112 to the mounting plate 102, one or more brackets 114, 116 may be used. As shown, each bracket 114, 116 may have an aperture 118, 120, respectively, for receiving the female receiving member 112. The female receiving member 112 may further comprise an end cap 113 at the bottom thereof. The end cap 113 may be welded to the female receiving member 112. A vertical support member 122 may be telescopically coupled to the mounting plate 102 via the female receiving member 112, with the support collar 110 being positioned at the coupling site. In other words, a male portion 123 of the vertical support member 122 is received by the female receiving member 112, with the male portion 123 abutting the end cap 113. The vertical support member 122 extends upwardly from the mounting plate 102, extending ideally to the height of a hip of a user (although such height is not required). The vertical support member 122 may extend upwardly at an angle from the mounting plate 102 as shown, although such an angle is not required. When the vertical support member 122 is angled, the second portion 106 is able to easily engage the vertical support member 122 due to its angle in relation to the first portion 104. A tethering component 124 is located at a top, distal end of the vertical support member 122. The tethering component 124 may have one or more tethering apertures 126 therein so as to accommodate easy connection of a cable.

While the above example used a female receiving member 112 receiving the male end of vertical support member 122, it will be appreciated that such configuration is not required and that multiple components could be combined into one. In other words, the female receiving member 112 and support collar 110 could be eliminated, with the vertical support member 122 being directly coupled to the brackets 114, 116 and/or mounting plate 102. However, using a female receiving member 112 allows a user to quickly and easily insert a vertical support member 122 of appropriate height for the task at hand. In other words, a user may have several lengths of vertical support members 122, allowing a user to quickly and easily change between heights so as to accommodate different mounting positions on a structure.

Further, while it is preferable for the female receiving member 112 and vertical support member 122 to be cylindrical, as shown, for improved structural integrity, this is not a requirement. In other words, these components may be cuboidal or any other configuration/form factor. Further, the vertical support member 122 may be solid or hollow. Although metals and steels are the preferred materials, the safety anchor 100 may be constructed of a variety of materials, as long as the materials have sufficient structural integrity so as to withstand the force of a worker falling. Further, if the components herein are made of metals or steel, the various components may be coupled to one another by welding. One benefit of a cylindrical configuration is that it allows rotation of the vertical support member 122, which allows for easy movement of a worker and for quick installation and connection with other vertical support members 122.

Figure 6:
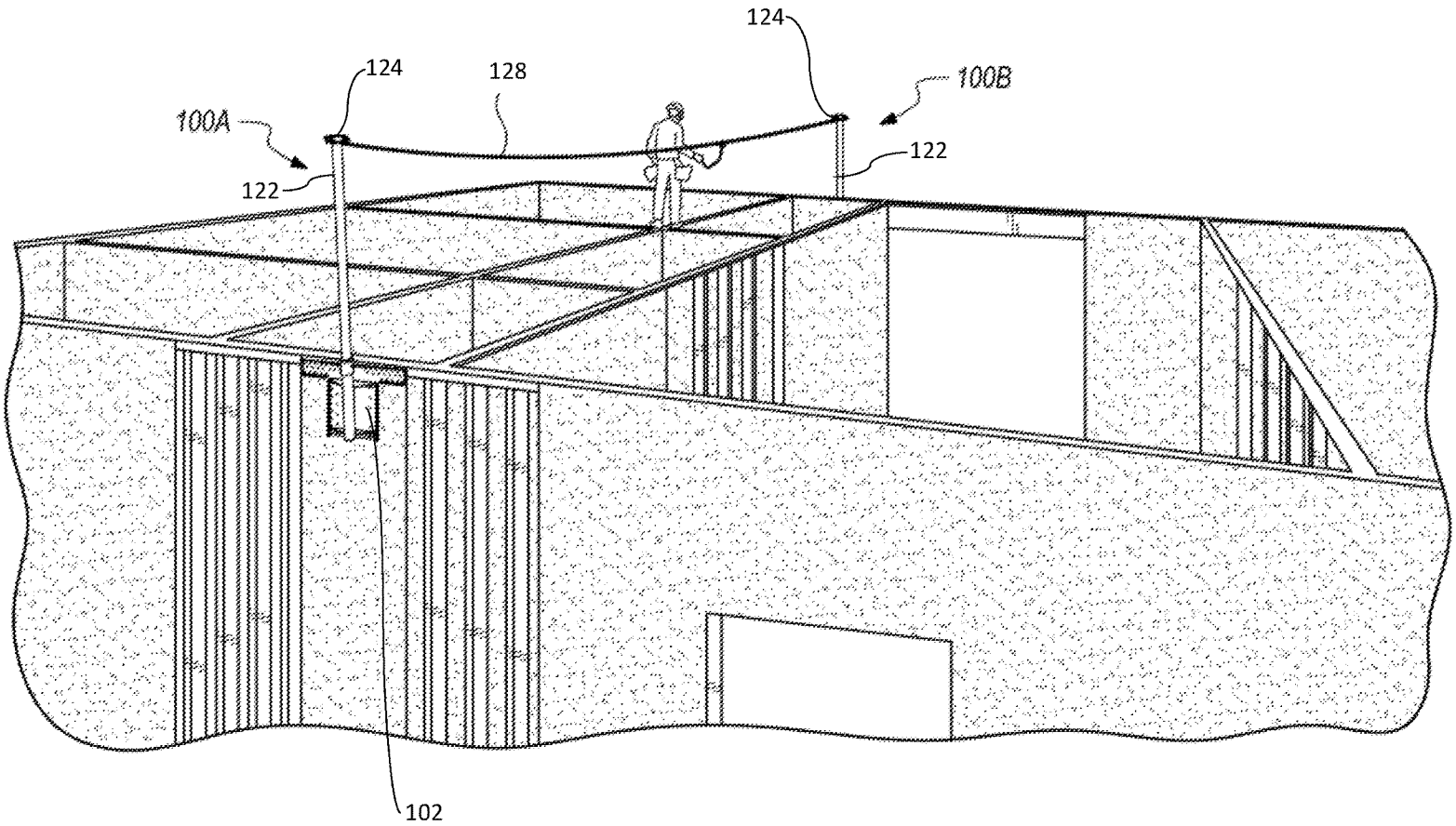
FIG. 6 illustrates a system tether system for use during construction.

In one embodiment, as shown in FIG. 6, a safety tether system for construction workers comprises a first safety anchor 100A and a second safety anchor 100B, and a cable 128 interposed between the tethering components 124 of the first and second safety anchors 100A, 100B. The safety anchors 100A, 100B may be secured to the structure by securing the mounting plate 102 to the wall of the structure using a securing means, such as screws, bolts, nails, or other means. The cable 128 couples the first safety anchor 100A to the second safety anchor 100B, such as by using the tethering apertures 126. With the cable 128 secured to both safety anchors 100A, 100B, a user may then tether themselves to the cable 128, such as by using a carabiner, so as to safely traverse the structure. For distances of excessive length, one or more intermediate safety anchors 100 may also be used. Accordingly, the present invention allows a user to quickly and easily secure a safety anchor 100 to any structure and allows the user to easily traverse the structure without worry of falling. Depending on the height of the vertical support member 122, the cable 128 may be around waist height for a user, making it easy and comfortable for a user to maneuver. However, it will be appreciated that any height may be used. Likewise, depending upon the structure, the safety anchors 100 may be placed at locations of varying height. To accommodate this, varying heights of support members 122 may be used, allowing a user to quickly mount the safety anchors 100 and begin work.

Accordingly, it is clear from the foregoing that the safety anchor and methods of use described herein solve the need for a safety tether that requires minimal assembly, that is easily removably attachable to a structure, and that allows for efficient mobility of the construction worker.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein.

What is claimed is:

1. A safety anchor for construction, comprising:

a mounting plate comprising a first portion and a second portion, wherein the second portion is angled in relation to the first portion, the second portion having an aperture for receiving a support collar, and a female receiving member coupled to the support collar;

at least one bracket for coupling the female receiving member to the mounting plate;

a vertical support member telescopically coupled to the mounting plate via the female receiving member, the vertical support member extending upwardly from the mounting plate; and a tethering component at a top, distal end of the vertical support member.

* * * * *